US006557272B2

(12) United States Patent
Pavone

(10) Patent No.: US 6,557,272 B2
(45) Date of Patent: May 6, 2003

(54) HELIUM MOVEMENT MAGNETIC MECHANISM ADJUSTABLE SOCKET SOLE

(76) Inventor: Luigi Alessio Pavone, 299 Nakoa Dr., Wailuku, HI (US) 96793-2456

( * ) Notice: Subject to any disclaimer, the term of this patent is extended or adjusted under 35 U.S.C. 154(b) by 0 days.

(21) Appl. No.: 09/905,336

(22) Filed: Jul. 13, 2001

(65) Prior Publication Data

US 2003/0009910 A1 Jan. 16, 2003

(51) Int. Cl.[7] ..... A43B 13/20
(52) U.S. Cl. ..... 36/29; 36/35 B; 36/28
(58) Field of Search ..... 36/29, 35 B, 28, 36/71, 30 R, 153

(56) References Cited

U.S. PATENT DOCUMENTS 4,887,367 A * 12/1989 Mackness et al. ..... 36/129
4,999,931 A * 3/1991 Vermeulen ..... 36/153
5,042,176 A * 8/1991 Rudy ..... 36/153
5,551,173 A * 9/1996 Chambers ..... 36/141
5,853,854 A * 12/1998 Nakanishi et al. ..... 36/22 R
5,894,687 A * 4/1999 Lin ..... 36/141
5,976,100 A * 11/1999 Greenawalt ..... 36/43
6,009,637 A * 1/2000 Pavone ..... 36/28
6,151,807 A * 11/2000 Qui et al. ..... 36/140
6,192,606 B1 * 2/2001 Pavone ..... 36/28

* cited by examiner

*Primary Examiner*—Mickey Yu
*Assistant Examiner*—Jila M. Mohandesi

(57) ABSTRACT

An improved sole for use with all types of footwear, including dress, casual, and athletic shoes and sandals, which has a socket casing made of a plurality of layers, the topmost surface of which is in the form of an accommodating orthopedic type molded foot bed, the innermost surface having embedded magnets, enclosing an adjustable helium bladder, and filled with a fluidic polymeric material. The amount of fluidic polymeric material may be increased or decreased through a valve in the socket casing. The helium bladder is adjustable through a valve in the socket casing. The socket casing is attached to the outsole by means of snap-like fasteners or other usual attachment methods such as adhesive glue or injection and replaces the insole and mid-sole.

1 Claim, 3 Drawing Sheets

HELIUM MOVEMENT MAGNETIC MECHANISM ADJUSTABLE SOCKET SOLE

FIELD OF THE INVENTION

The present invention relates generally to all types of footwear, including casual shoes, dress shoes, athletic shoes and sandals, and specifically to an improved sole and footwear incorporating such soles.

BACKGROUND OF THE INVENTION

The advantages of a gas filled sole are well known and are discussed in some detail in a number of patents, such as the discussions in U.S. Pat. Nos. 6,009,637 and 6,192,606. Soles filled with gasses provide stability, anti-gravity and resiliency superior to that achievable with material soles. The choice of gas or gas mixtures combined with fluidic polymeric material used in soles affects not only mechanism of the footwear sole but also the degree of resiliency and elasticity of the mechanism and the movement of the sole by increasing or decreasing the rigidity and flexibility of the socket by inflating with the fluidic polymeric compound through a valve in the socket casing of the present invention. This enables the wearer to use the same shoes with varying sole hardness corresponding to different activities and occasions. Also the action of the helium bladder with the corresponding action of the opposing polarity of the magnets is an optimum choice of gas pressed by magnetic force for use in soles. It is particularly for use in athletic shoes which will utilize the body pressure on the magnets of the socket casing in the shoe sole to provide a substantial body rebound action for running, which recycles and helps age-defying conservation of body energy. Despite the need for resiliency and the movement mechanism of the socket casing, the sole of the footwear must also provide sufficient support to the foot and must be sufficiently durable to provide stability and an acceptable service. Furthermore, it is advantageous for the amount of support and resilience provided by the sole to different areas of the foot to vary as the stride of the wearer progresses. That is, in walking, jogging or running, the area of the foot in contact with the ground rotates from the heel to the ball of the foot. In the present invention, magnetic pads with opposing poles are positioned in these areas of the socket casing to work with the helium in the bladder to assist the gas to flow into and out of the connecting chambers of the bladder, which are also lying beneath the ball and the heel areas of the foot. Because of the lightweight of helium, as the gas moves between the chambers, and by utilizing the polarity of the magnetic pads to create an opposite push back which will have a significant effect on the helium movement, the present invention thus imparts a lift to the foot facilitating the natural roll of the stride.

The present invention is an improvement to the invention disclosed and claimed in U.S. Pat. No. 6,192,606 issued on Feb. 27, 2001 and entitled "Helium Filled Sole." The '606 patent describes a sole with a helium bladder having core modules filled with helium. One of the difficulties associated with the type of helium filled soles described in the '606 patent is the propensity of the helium to move through the bladder rapidly. The present invention controls this characteristic of helium by utilizing the pressure of the foot contact to the magnetic pads of opposing poles to create a natural mechanism for the helium rebound action. The present invention thus provides a sole, which impedes uncontrolled flowing of the helium throughout the bladder, and uses the magnetic poles to create a natural orderly movement pattern for the helium. As discussed in the earlier '606 patent, the foot can generate great amounts of pressure during any kind of ambulation, including walking, jogging and running. Footwear manufacturers and designers attempt to ameliorate the discomfort of the foot and ankle with an air sole or by using softer materials to construct either the sole or as padding on top of the soles of footwear. Soles comprised of a soft material are generally not as durable as soles made of rigid or semi-rigid materials. Inserted insole padding materials have a tendency to flatten and compress with use thereby decreasing the cushioning provided to the foot. The present invention has a three fold solution to these problems with 1) a valve in the socket casing that enables the wearer to increase or decrease the amount of fluidic polymeric material in between the socket casing and helium bladder according to the degree of support or cushioning needed and may also be used for a hidden total height increase of up to two (2) centimeters, 2) a valve for the helium bladder which enables the wearer to increase or decrease the amount of helium in the bladder according to the degree of helium rebound action required and can raise the height of the bladder core up to one-half (½) centimeter and 3) a topmost surface in the form of an orthopedic type molded foot bed with a beaded surface and which, when the socket casing is adjusted as previously stated above in 1), adjusts to further accommodate the foot for better fit while also stabilizing the foot without any need for an insole. Still other manufacturers offer air bag soles to be used for shock absorption. Such soles, however, have been known to cause discomfort to the ankle. A study by a group of orthopedic doctors shows that air bags had a major impact on a lot of twisting foot ankle injuries due to the instability of the foot. This has been solved in the present invention. Air bags also do not provide a pressure absorbing and down grading motion to our foot strike while in return the natural magnetic force will create an opposite push back which will have a significant effect on the helium to recycle and provide a lift and elasticity obtainable with only the soles of the present invention.

There is a need, therefore, for a sole with a different approach, which provides stable adjustable support and rebound action for energy recycling and conservation.

SUMMARY OF THE INVENTION

It is an object of the present invention to provide a magnetic adjustable mechanism socket casing with an accommodating orthopedic type molded and beaded foot bed in a footwear sole that accommodates an adjustable helium filled bladder and utilizes the polarity of the magnets to create a mechanism to effectively control the flow of the helium creating a rebound movement under our feet producing a natural massage while providing stable support and recycling and conserving energy and is a total replacement of a regular insole and mid-sole.

It is a further object of the present invention to provide a sole with a socket casing of superior cushioning properties.

The present invention provides a sole which contains a socket casing with an accommodating orthopedic type molded and beaded foot bed enclosing an adjustable helium injected bladder surrounded by upper and lower magnetic pads of opposing poles that produces a mechanism to control the flow of the helium from the heel area to the ball area and back when foot pressure is released and which fluidly conforms to the shape of the foot during the stride. More specifically, the sole of the present invention is comprised of four sections: (1) a socket casing approximately the shape of the footwear with an accommodating orthopedic type molded foot bed having a heel cup, arch support, toe ridge and small rounded protrusion-like bumps molded in the upper surface of synthetic materials such as polyethylene terephthalate (PET), thermo plastic urethane (TPU), liner low density polyethylene (LLDPE), other types of polyurethane (PU), and/or other short chain alkene polymers, and an inner surface of synthetic materials having molded indentations of substantially the same shape as the bladder embedded with magnetic pads of opposing poles, enclosing (2) a helium filled bladder adjustable through a valve in the socket casing, with a plurality of chambers with a heel and ball area positioned between the upper and lower embedded magnetic pads, (3) an outsole having substantially the same shape as the heel and ball section of said socket casing, made of a plurality of layers of synthetic material, such as polyisoprene and polyisobutylene attached to the outsole by means of snap-like fasteners or other usual attachment methods such as adhesive glue or injection; and (4) a layer of a fluidic polymeric material between said socket casing and said bladder, which is adjustable (in regards to amount and even color if desired) through a valve in said socket casing.

DETAILED DESCRIPTION OF THE INVENTION

Figure 1:
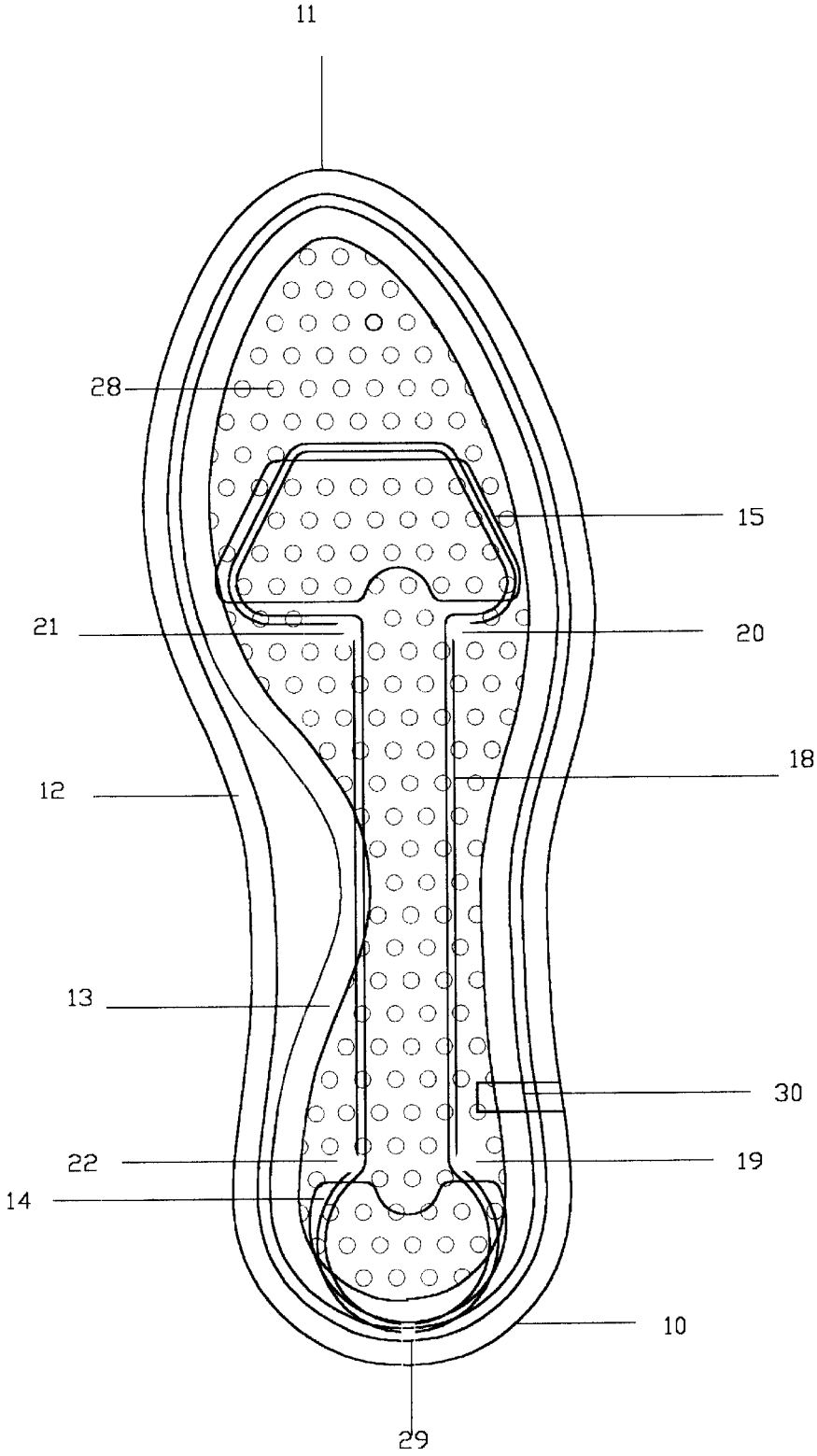
FIG. 1 is a top view of the present invention illustrating the general shape of the socket casing with a plurality of layers and components.
Figure 3:
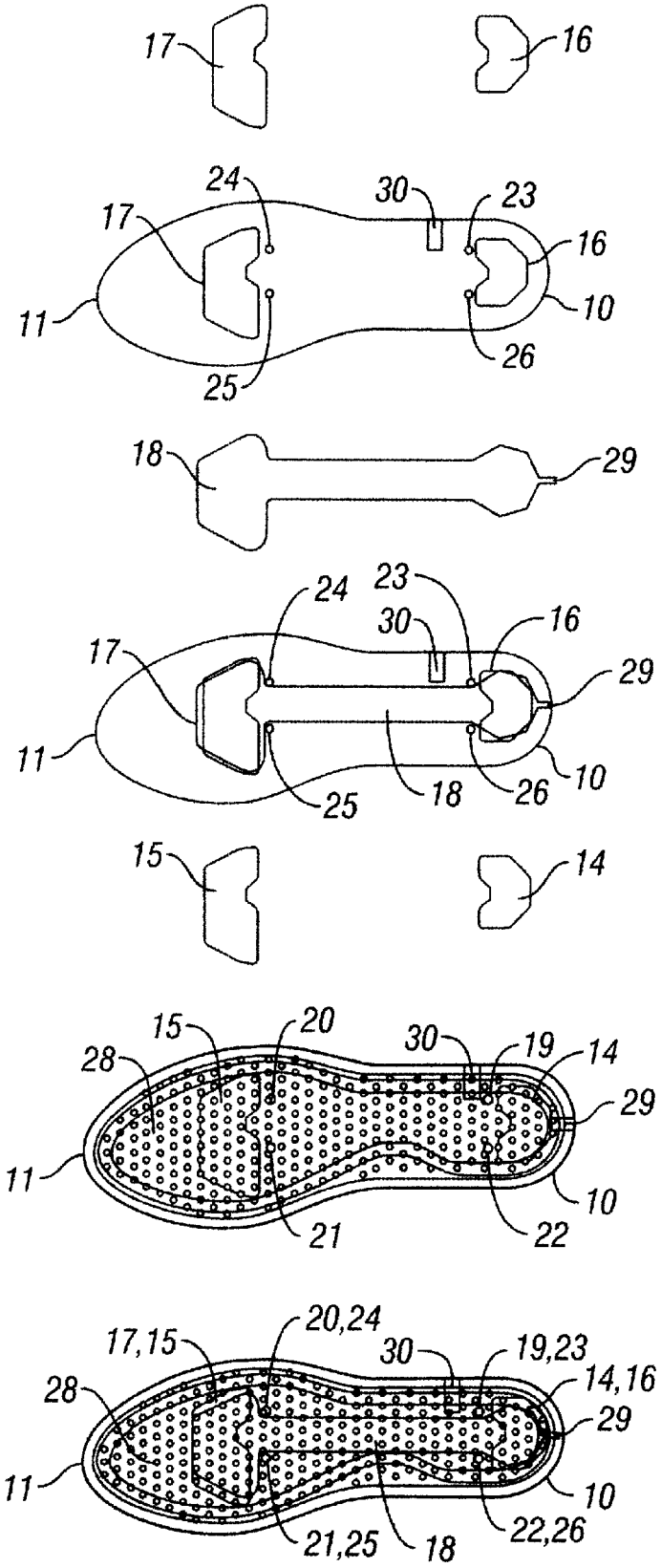
FIG. 3 is top view of the components and separated layers of the present invention.

Referring to all FIGS., the socket casing of the present invention is molded into substantially the shape as shown in FIGS. 1 & 3 with a heel end 10, heel area, ball area, and toe end 11 and is constructed of an outer perimeter 12 and an inner perimeter 13 comprised of a plurality of layers of polyethylene terephthalate (PET), thermo plastic urethane (TPU), liner low density polyethylene (LLDPE), other types of polyurethane (PU), and/or other short chain alkene polymers. In the inner perimeter surface 13 are magnetic pads 14–17 embedded in the upper and lower surfaces of the heel area and ball area. Magnetic pad 14 is above the heel area of the helium bladder 18 and is the same polarity as magnetic pad 16, which is below the heel area of the helium bladder 18. Magnetic pad 15 is above the ball area of the helium bladder 18 and is the same polarity as magnetic pad 17, which is below the ball area of the helium bladder 18. Helium bladder 18 is held in place by snap-like fasteners 19–22 protruding from the upper surface of inner perimeter 13, which affix into indentations 23–26 in the lower surface of inner perimeter 13. In the preferred embodiment of the present invention outer perimeter 12 has an upper surface 27 molded into an accommodating orthopedic type foot bed with a heel cup, arch support, and toe ridge, and which is covered with 4–6 millimeter molded bumps 28 over the entire length and width. Upper surface 27 eliminates the need for an added insole and when the socket casing is adjusted through the increase or decrease of the fluidic polymeric material interposed between the socket casing and helium bladder in space 31 through valve 30, the orthopedic type molded foot bed will also adjust to better accommodate the foot for better fit and provide stability for the foot, while also providing the degree of support cushioning needed and also additional height. Valve 30 runs through the socket casing layers 12, 13 and in the preferred embodiment of the present invention, is located at the outer side heel area, but may be located in any other area of the footwear. Another valve 29, protrudes from the heel end of helium bladder 18 and through all socket casing layers 12, 13 and ending at the socket casing heel end 10, but may be located in any other area of the footwear, allows the wearer to inflate or deflate helium bladder 18 as needed with a can or similar portable device. It will be understood that valves 29, 30 may be any of a variety of currently available valves, such as self-sealing diaphragms.

As previously described in the '606 patent, the fluidic polymeric compound is composed of a mixture of a short-chain glycol, such as ethylene or propylene glycol, a short-chain alkoxylated alcohol, such as butxy ethanol, and acetone, and a desiccant, preferably in the form of a silicate salt, such as sodium silicate. Additional elements of the fluidic polymeric compound may include surfactants and/or fibrous plugging and matting agents and/or colorants. Any of a number of currently available surfactants, soluble in the glycol/alcohol/silicate mixture could be used, such as sodium lauryl sulfate. Fibrous plugging and matting agents are currently available, including for example, fibrous cellulosic materials. The layer of fluidic polymeric material provides an improvement in the ability of the sole to conform to the shape of the foot during a stride thereby increasing comfort while providing support. The fluidic polymeric material further strengthens the helium bladder by providing a counter-pressure to that imposed by the foot. The combination of resiliency and conformability provided by the fluidic polymeric material prevents the helium bladder from bursting while yet remaining comfortable for the wearer. The valve 30, further assists in the resiliency and conformability of the present invention by enabling the amount of the fluidic polymeric material to be increased or decreased as needed by the wearer according to activity and to even adjust or change the color of the fluidic polymeric material if so desired.

As the heel strikes the ground, the magnet pads 14 & 16 will come together and push down on the heel area of helium bladder 18, pushing the helium in helium bladder 18 out of the heel area through the tubes in the neck area and into the ball area of the bladder (as described in the '606 patent). As the foot rotates through the stride to place pressure onto the ball of the foot, the magnet pads 15 & 17 will then come together against its own nature and push down on the ball area of helium bladder 18 while at the same time as pressure is released from the heel area the magnet pads 14 & 16 are pushed apart due to the action of the opposing poles of the magnet pads 14 & 16 thus providing a controlled route for the helium to escape. Again as the foot rotates through the stride and the heel once again strikes the ground, this process will be repeated. And because helium gas is very light, the helium will flow more rapidly than would air or heavier gasses, as are commonly used in athletic footwear. This rapid flow of helium will assist in the natural rotation of the foot stride thereby imparting additional lift and power to the wearer. The action of opposing poles creates a natural mechanism for the helium rebound action.

The present invention thus provides a sole, which impedes uncontrolled flowing of the helium throughout the bladder, and uses the magnetic poles to create a natural orderly movement pattern for the helium.

Figure 2:
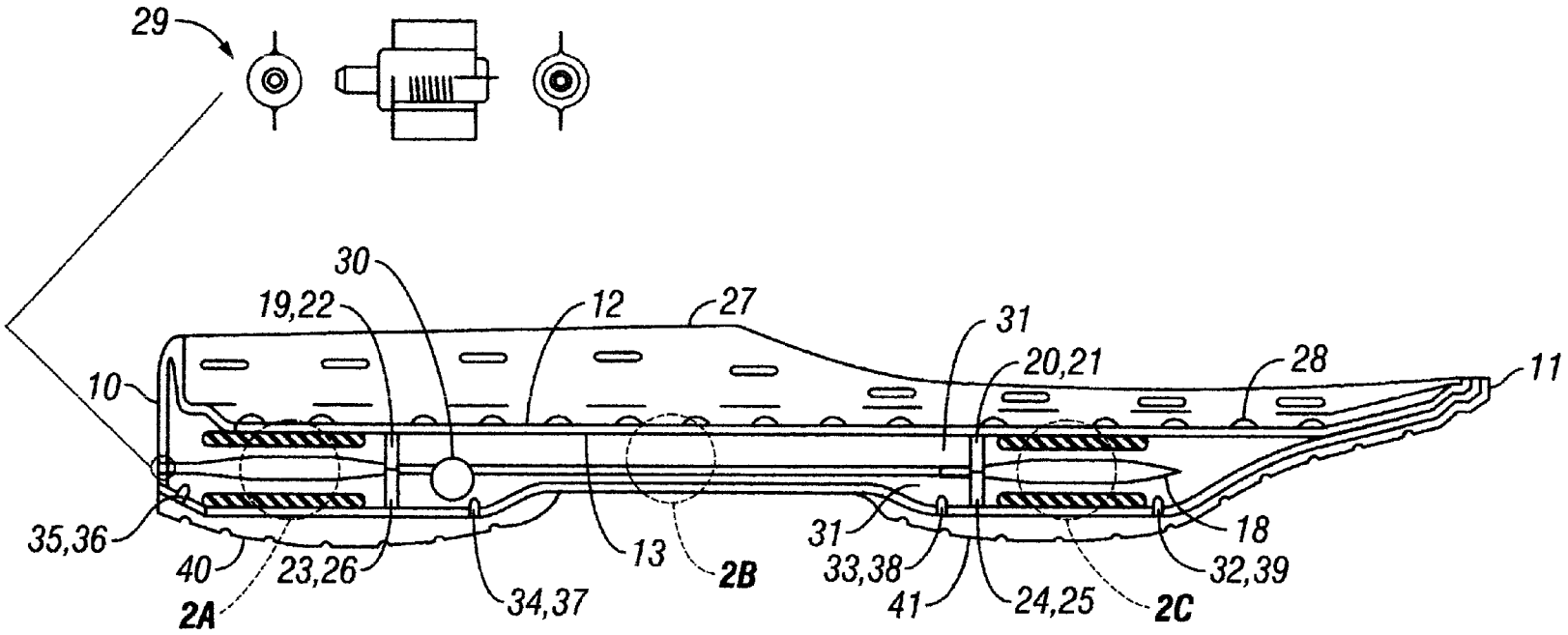
FIG. 2 is a cross-sectional view of the socket casing along with the bladder and the outsole of the present invention taken at the lengthwise axis of the sole with exploded side perspective views of the socket casing and the bladder of the present invention at three different points: A) the heel area, B) the arch area, C) the ball area.
Figure 2C:
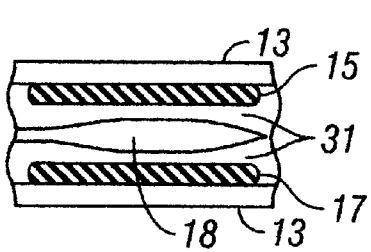
Figure 2B:
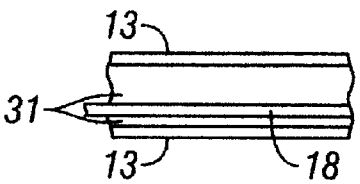
Figure 2A:
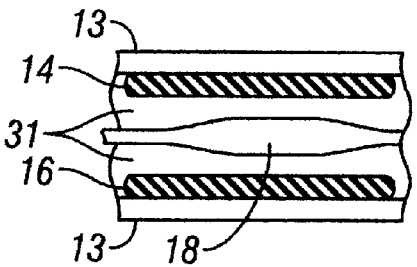

Referring now to FIG. 2, the socket casing is comprised of two layers of material: (1) an inner layer 13, of approximately 2 millimeter thickness into which are engraved spaces to accommodate magnet pads 14–17, of approximately 2–4 millimeter thickness, in crescent-like shape much like those depicted in FIGS. 1, 2, and 3 for the heel area 14 and 16 and trapezoidal-like shape much like those depicted in FIGS. 1, 2, and 3 for the ball area 15 & 17, made of polyethylene terephthalate (PET), thermo plastic urethane (TPU), liner low density polyethylene (LLDPE), other types of polyurethane (PU), and/or a short chain alkene polymer; which is surrounded by (2) an outer layer 12, of polyethylene terephthalate (PET), thermo plastic urethane (TPU), liner low density polyethylene (LLDPE), other types of polyurethane (PU), and/or a short chain alkene polymer, of approximately 2 millimeter thickness.

While the invention has been described herein by way of specific embodiments, it will be understood that the invention may be embodied in other forms.

I claim:

1. A footwear sole comprising:

an adjustable socket casing having an outer perimeter and an inner perimeter comprising a plurality of layers consisting of polyethylene terephthalene (PET), thermo plastic urethane (TPU), liner low density polyethylene (LLDPE), polyurethane (PU), Butyl Rubber and Thermo Plastic Rubber (TPR);

said inner perimeter having embedded magnetic pads of opposing poles in an upper surface and lower surface layer in the heel and ball areas and snap-type fasteners protruding in the upper surface layer of the inner perimeter which affix into indentations in the lower surface layer of the inner perimeter;

a bladder with a plurality of connecting chambers, said chambers filled with helium adjustable by increasing and decreasing the amount of inflation through a first valve in said socket casing, the bladder is positioned between said upper surface layer and lower surface layer of said inner perimeter with said magnetic pads of opposing poles corresponding above and below the heel and ball areas of said bladder, and held in place by said snap-type fasteners of said inner perimeter;

said outer perimeter having a molded upper surface comprising of small rounded protrusion-like bumps and in the form of an accommodating orthopedic type foot bed which can be increased in size by inflating said socket casing through a second valve, and a bottom surface, which is substantially flat with indentations in the heel and the ball area of the outer perimeter;

an outsole with protruding snap-type fasteners on an upper surface in the area of the heel and the ball areas corresponding to said indentations in the bottom surface of the outer perimeter;

said upper perimeter surface of said outsole is affixed to said bottom surface of said outer perimeter of said socket casing; and a layer of fluidic polymeric material interposed between said socket casing layers and said bladder, which is adjustable by increasing or decreasing the amount and the color, of the material through the valves in said socket casing.

* * * * *